US005112453A

United States Patent [19]

Behr et al.

[11] Patent Number: 5,112,453

[45] Date of Patent: * May 12, 1992

[54] METHOD AND APPARATUS FOR PRODUCING ETCHED PLATES FOR GRAPHIC PRINTING

[76] Inventors: Omri M. Behr; Marion R. Behr, both of 24 Fishel Rd., Edison, N.J. 08820

[ * ] Notice: The portion of the term of this patent subsequent to Apr. 7, 2009 has been disclaimed.

[21] Appl. No.: 788,244

[22] Filed: Nov. 5, 1991

Related U.S. Application Data

[63] Continuation-in-part of Ser. No. 606,871, Oct. 31, 1990, Pat. No. 5,102,520.

[51] Int. Cl.[5] ..... C25F 3/14; C25F 7/00

[52] U.S. Cl. ..... 204/129.2; 204/129.65; 204/224 M; 204/228; 204/277; 204/238; 204/275; 204/237

[58] Field of Search ..... 204/129.65, 129.75, 204/224 M, 129.2, 237-238, 275, 228, 277

[56] References Cited

U.S. PATENT DOCUMENTS 984,011 2/1911 LaPointe ..... 204/129.75 X
2,394,190 2/1946 Kreck ..... 204/129.75 X
4,247,377 1/1981 Eckler et al. ..... 204/129.65
4,269,679 5/1981 Moura ..... 204/129.65
4,560,464 12/1985 Lieber ..... 204/129.65 X
4,729,940 3/1988 Nee et al. ..... 204/129.65 X

*Primary Examiner*—Donald R. Valentine
*Attorney, Agent, or Firm*—Omri M. Behr

[57] ABSTRACT

There is provided an apparatus and a process for using same for etching a metallic object (22), suitably a plate to prepare a metallic printing plate. The object is partially covered by a resist surface (14) wherein the exposed portions (16) of said metal, will be exposed to the action of an electrolytic etchant force. The apparatus comprises a bath (10) for an aqueous electrolyte (12), an electrode (23), suitably but not critically metallic, immersible in said electrolyte, which will serve as the cathode, a source of direct current voltage (32), which may further be associated with adjustment means (38) for controlling the applied voltage. The voltage should be adjustable to operate accurately within a rather narrow voltage range, such that the minimum voltage shall be at least that of the ionization potential of the metal of the metal object in the electrolyte chosen and the maximum shall not substantially exceed the sum of the decomposition voltage of the aqueous electrolyte and the over-voltage of the cathode selected.

30 Claims, 6 Drawing Sheets

METHOD AND APPARATUS FOR PRODUCING ETCHED PLATES FOR GRAPHIC PRINTING

RELATED APPLICATIONS

This application is a continuation in part of applicants' co-pending application Ser. No. 07/606,871 filed Oct. 30, 1990 now U.S. Pat. No. 5,102,520.

FIELD OF THE INVENTION

Environmentally acceptable etching of metals.

BACKGROUND OF THE INVENTION

The art of etching metal plates in order to produce a reproducible image is centuries old. The basic principle involves putting a resist coating on the surface of a clean smooth metal plate, removing a portion of this resist with a suitable tool such as a needle and then immersing the metal plate for a predetermined time in an acid bath in order to bite or remove a portion of the metal which is exposed thereby. The resist is then dissolved off, usually by means of a solvent, and a printing ink rubbed into the surface of the plate. The plate is then rubbed with a cloth to remove all or substantially all of the ink that does not reside within the grooves caused by the etching process. The plate is then laid face up on a suitable surface, covered with a suitably prepared, usually moist paper sheet and pressure applied thereto, usually by means of roller press. This procedure causes the ink to be transferred from the grooves in the metal plate on to the paper to give the printed image.

These techniques have been used to create deep and wide cuts in the plate to provide an effect on the paper known as embossing.

In a well known variation of the acid etching process, known as aquatinting, the resist does not totally and completely cover the metal plate. There are various methods for producing aquatint. The most common of these is to deposit a thin dust film of rosin on the plate and heating the plate just enough to make a major portion of the rosin adhere to the plate but not enough to produce a uniform coating. When this plate is placed in an acid bath the acid will attach those portions of the metal to which the rosin does not adhere. Other methods of aquatinting are well known to those skilled in the art of graphic printing. The metals generally speaking, used to produce etchings are zinc or copper, brass and steel have also been used, bronze and iron can also be employed but are not as favored.

A further embodiment of aquatinting is known as sugar lift wherein a mixture of syrup, tempera paint and soap flakes is painted onto a rosined plate, the painted plate placed first in water, to achieve the lift, and then in acid to provide a very "soft" printable image.

Whatever metal is used the general principle is the same. In order to achieve the etching or removal of metal rather strong acid media are employed. These can be either nitric acid or a medium generally known as "Dutch mordant" which comprises hydrochloric acid and potassium chlorate as its main constituents. Both etching solvents require substantial ventilation to protect the worker from the fumes which are generated in the process. Unfortunately, it has been found that artists who practice these processes are not sensitive to the health dangers involved and work directly above the acid baths in order to carry out certain brushing steps to obtain the bite which they desire. The provision of acid proof masks is not generally practical and if available would usually not be employed by artistic workers. Furthermore, the exhausted baths, that is to say baths whose content are still acidic but are not longer of sufficient strength to be useful in the etching process must be disposed of by steps of neutralization which are expensive and often ignored. Furthermore, even if neutralized the baths still contain large quantities of metal which, where copper is a content of the metal, are exceedingly environmentally harmful.

The rather dangerous nature of the etching process has therefore, restricted its use to the professional level and in institutions of higher learning. The principle of etching however, would be exceedingly instructive to younger students if a methodology could be made available which was totally safe for unskilled persons such as students of grammar school or high school age.

It is well known that where a metallic plate is placed in an electrolytic bath having another electrode and a source of direct current is applied to said electrodes through said electrolytic bath in such a way that a metallic plate becomes the anode, metal irons will pass from the anode to the other electrode (cathode). It was recognized at a very early stage that this principle could be utilized to create etched plates, for example, Schwuchow and Johnston, U.S. Pat. No. 1,047,995, who utilized zinc half-tone plates at a current of about 10 volts for from about 1 to 2 minutes. It was recognized by Holland in U.S. Pat. No. 2,074,221, that the efficiency of anodic etching could be increased by agitating the plates and a further mode of agitation was provided by T. F. Johnstone, in U.S. Pat. No. 2,110,487, in which a blast of air was bubbled through the electrolytic medium as an agitating means.

Corbet, in U.S. Pat. No. 2,536,912, recognized that under the rather vigorous conditions which he utilized, namely, etching at 6 volts utilizing a current of approximately 35 amperes, the pH of the solution tended towards the basic side and that is was desirable to maintain the slightly acidic nature of the electrolyte by the addition of acid. Other workers such as Raviv, et al., U.S. Pat. No. 3,635,805 and King, et al., U.S. Pat. Nos. 3,843,501 and Inverso, 4,098,659, have utilized the principle of metallic etching for very deep cutting of metal, analogous to utilizing a lathe without the currents of metallic structure deterioration due to the heat generated in such lathing processes.

Nee et al. U.S. Pat. No. 4,729,946 discloses a method of etching discs to be used as laser-read compact discs which had previously been plated with a thin layer of copper. Parts of the copper plate are were covered with a photo resist. It is specifically stated in the specification that this copper layer is fine grained. Thus this copper layer does not have the courser grained structure of metals items which are derived from the molten state such as cast objects or plates rolled from ingots. The exposed portions were electrolytically etched out to a predetermined depth by connection to the anode of a direct current source of about 6 volts. The electrolyte used was an alkaline medium containing alkali metal or ammonium cations. It is further noted that this procedure requires a cathode bag to catch the copper "plated" to but not retained by the cathode. Such non-adhesion is characteristic of electrolytic cells operating at such relatively high voltages.

Notwithstanding the aforementioned patents directed to anodic etching, there is no mention of anodic etching as a suitable graphic arts process in any old or recent text directed to printing methods for artists. In particular, the recent well accepted major treatises entitled Printmaking, History and Process by Saff & Sacilotto, Holt Rinehart & Winston, New York, 1978 ISBN 0-03-042106-3 and Complete Printmaking, Ross et al., (rev. ed) Free Press, New York, 1989 ISBN 0-02-9273714, make no mention of anodic etching.

The problem with the anodic etching processes of the prior art is that they operate at high voltages and rather substantial current levels, which give rise to the generation of gases such as oxygen and hydrogen, which in certain concentrations, when mixed, are exceedingly explosive and therefore would create a hazard in the work place where electrical sparks cannot be avoided.

In the electroplating arts, voltages are kept under about 2 v., since the generation of hydrogen bubbles at the cathode where the plating is deposited, interferes with a smooth, well-adhering deposit. It would therefore be desirable to create a process and design an apparatus wherein it was possible to reproduce the effect on a metal plate of traditional etching techniques, which would include not only reproduction of exceedingly fine lines such as those obtained by the non-acid etching procedure generally known as dry-point, to the variously deep engraved lines obtained in traditional etching processes, (i.e., intaglio) to the more vigorous removal of metal in such processes known as the production of embossing plates, wherein depths exceeding 1 mm. are achieved in the plate. Such a methodology should also include the availability of surface modifications techniques which are traditionally known as aquatinting and sugar lift.

SUMMARY OF THE INVENTION

The solution of the problem posed by traditional anodic etching procedures is solved by operating in a very narrow voltage range wherein the minimum voltage is controlled by that potential necessary to convert the metal of the etched object or plate into ionic form and the maximum is that voltage above which hydrogen gas is generated at the cathode.

In accordance with the illustrative embodiment demonstrating features and advantages of the present invention a process is provided for etching a roughened surface directly onto a metallic object, the original surface whereof is partially covered by a resist surface and causing the thus exposed portions of said metal object to be subjected to the action of an etchant force in an electrolytic bath containing an aqueous electrolyte, an electrode and a source of direct current voltage having a positive pole and a negative pole. The process comprises the steps of immersing said metallic object to be etched in said bath proximate to but spaced from said electrode, connecting the negative pole of said direct current voltage source to said electrode and the positive pole to said metal object whereby said electrode becomes the cathode and said metal object becomes the anode. The process is characterized by providing that the level of applied voltage is such that it shall be at least that of the ionization potential of the metal of the object in the electrolyte chosen and shall not substantially exceed the sum of the decomposition voltage of the aqueous electrolyte and the over-voltage of the cathode selected, whereby hydrogen evolution is avoided. Said selected is applied voltage until the desired depth of metal has been removed from the exposed portions of the anode and the desired degree of roughness attained thereon.

There is further provided an apparatus for etching a roughened surface onto a metallic object the original surface whereof is partially covered with a resist surface by causing the thus exposed portions of said metal object to be subjected to the action of an electrolytic etchant force. The apparatus comprises a bath for containing an aqueous electrolyte, an electrode located in said bath and immersible in said electrolyte to form a cathode, a source of direct current voltage whose positive pole is adapted for connection to said object when immersed in said electrolyte proximate to but spaced from said electrode, the negative pole of said source being adapted for connection to said electrode when immersed in said electrolyte. The apparatus is characterized by means for controlling voltage so that the magnitude of voltage from said source is at least that of the ionization potential of the metal of the object in the electrolyte chosen and not substantially greater than the sum of the decomposition voltage of the aqueous electrolyte plus the over-voltage of the cathode selected whereby hydrogen evolution is avoided.

This voltage adjustment means should be able to operate accurately within a rather narrow voltage range, suitably between about 0.3 and about 2.5 volts with a sensitivity of about $\pm 0.01$ v, preferably 0.001 v. This is required because the voltage range for the process is such that the minimum voltage shall be at least that of the ionization potential of the metal of the metal plate in the electrolyte chosen and the maximum shall not substantially exceed the decomposition voltage of the aqueous electrolyte plus the overvoltage of the cathode selected. The term "substantially" as used herein, means that if the stated voltage is exceeded this excess is such that there shall be no observable generation of hydrogen at the cathode or oxygen at the anode.

The resist coated metallic object, suitably a plate, to be etched is located in said bath proximate to but spaced from the electrode which will become the cathode when the negative pole of said direct current source is connected to it and the positive pole to said metal plate (which has, suitably, an exposed, non-immersed segment sufficient to make such a connection) via said voltage adjustment means whereby said plate becomes the anode.

The apparatus may be modified by certain additional components which are not novel per se but constitute useful modifications of the novel apparatus. There may thus be provided a means for passing a stream of air through said electrolytic cell, a means for sensing the pH of the electrolyte and/or a means for adjusting the pH of the electrolyte. There may also be provided a means for sensing and/or adjusting the temperature of the electrolyte. For the achievement of certain interesting and unusual effects there may also be provided a means for arranging that the polarity of the anode and the cathode as originally designated are reversed at least once during the course of the process. Additionally there may be provided an electrolyte circulation means and one or more electrolyte jet means for projecting electrolyte towards or between the electrodes. Suitably, if desired, the jets may be directed to impinge perpendicularly onto the surface of the metallic object to be etched. Such jets are driven by a pump, suitably a magnetic pump. A filter means may also be interposed into the electrolyte flow circuit.

In this novel process of etching a metallic plate to prepare a metallic printing plate, a resist surface, suitably a substance known as "ground" (which may be of the variety known to graphic artists as either "hard" or "soft" i.e. "Vernis noir satine pour gravure marque Lamour" #3764 or "Vernis noir mou pour la gravure" #33190, both manufactured by LeFranc & Bourgeois, Le Mans, France and sold by Charbonnel, Paris, France)) is applied to said plate and portions of said metal plate originally covered by said resist surface are caused to be exposed, or portions may be initially left uncovered. Included in such initial and well known modes of preparation is the application and adhesion of rosin in the conventional mode of preparation for aquatinting.

As in the conventional preparation for etching, the rear face of the plate (or object) is covered with a resist material. Zinc plates for etching are usually sold with such a resist backing painted thereon. Where this is not initially present as in copper plates or solid objects, the rear surface may be covered with paint, hard ground or where flat with adhesive polymeric sheets (sold under the trade name Con-Tact ®, by Rubbermaid Corporation of North Carolina, U.S.A., for example). Since sharp edges are well known to concentrate electric current, care should be taken to coat the edges which are present. Where embossment or large surface aquatinting by the direct method is desired, the front face can be covered with such adhesive polymeric sheet and the areas to be treated cut away.

The thus conventionally prepared plate is then subjected to the action of an electrolytic etchant force. The portion of the metallic plate to be etched is immersed in said bath proximate to but spaced from said electrode. A small, non immersed area may be exposed at the top of the metal plate to provide for an electrical connection, where the plate is etched in the vertical plane. Alternatively, or where etching occurs in the horizontal plane, contact is preferably made in an insulated manner discussed in detail below. The negative pole of said direct current source is connected to said electrode and the positive pole to said metal plate via said voltage adjustment means whereby said electrode becomes the cathode and the metal plate becomes the anode.

The applied voltage is so controlled so that it shall be at least that of the ionization potential of the metal of the metal plate in the electrolyte chosen and shall not substantially exceed the decomposition voltage of the aqueous electrolyte plus the over-voltage of the cathode selected. From a practical point of view this means a range of between about 0.3 to about 2.5 volts. Since the rate of etching is substantially proportional to the applied voltage, operating at the lower end of this range, say 0.4 to 0.7 volts, preferably 0.5 volts gives better control of etch depth where fine variations are sought. Etch times are suitably between 5 and 45 minutes, though longer times may be employed. Where embossment is desired the length of time of operation of the process will depend on the thickness of the plate and the depth of embossment desired. Thus an 18 gage copper plate may be entirely penetrated at 1 v. in about 25 hours.

Since commercially available metals are seldom totally pure (i.e. unitary crystal structure, less than 0.001% impurities), a useful and interesting effect arises in when surfaces, whether mere lines or larger areas are exposed to potentials at this level in this environment. Since low voltage electric current is far more sensitive to the electrochemical environment than acid, the crystalline structure of the metal is differentially eroded, thus the newly exposed surface is no longer totally smooth. By varying the voltage applied to an anode, surfaces of different roughness, which simulate the aquatint effect, may be readily created. Thus where an embossment is created, in contrast to prior art, i.e. acid methods, the residual base of the embossment, if still present, will be roughened, thus can hold ink and be printed, if this is desired.

Where such roughening of the surface is desired to simulate an aquatint, times of exposure may vary from about 15 minutes for a very pale grey to 8–22 hours for dark grays or blacks. The selected voltage is then applied until the desired degree of roughness has been achieved.

The process may be interrupted at any time to inspect the plate in or out of the bath, since, contrary to the acid processes of the prior art, etching stops the moment the current is cut off. The metal plate may lie vertically or horizontally in the bath. The former mode is usually but not exclusively preferred. The conventional procedure or "stopping out" certain etched areas and continuing the etching in others is applicable to the present process.

The metal of the metal object may be of any metal which may be graphically etched by conventional means such as zinc, copper, brass, bronze, iron or steel. However, where the process is employed for the production of decorated, embossed or carved jewelry such as earrings, brooches, rings, necklaces or the like, noble or precious metals such as gold, silver, platinum, palladium and the like may be used. In this latter case, the process not only as the advantage of avoiding the use of the exceedingly corrosive acids needed to etch these metals, but there is also total recovery of all of the metals removed from the etched object on the cathode. While this recovery also occurs with ecological advantage with the cheaper base metals, in the case of the precious metals the cost saving can be substantial.

While herein the term "plate" is often used, as the principle contemplated use is for printing graphics plates, the process and apparatus are equally applicable for use with objects of any shape or size having at least one exposable metal surface.

The process may be carried out at a pH of less or more than 7. The exact pH chosen will depend on the metal utilized and the surface effect desired. For regular etching slightly acidic conditions are desirable to prevent precipitation of heavy metal oxides or hydroxides. A pH of 3 is usually sufficiently low and the dumping of solutions of this level of acidity caused no environmental problems or there use, personal hazards.

The process may be carried out utilizing an electrolyte containing cations of at least one of the metals constituting the anode. That is to say, for example, a solution of copper or zinc ions suitably of their sulfates. Alternatively, one may utilize an electrolyte contains no cations of the metals constituting the anode, for example ammonium sulfate. The results obtained with electrolytes which do not contain ions of the metallic object, i.e. ammonium sulfate, are not as satisfactory as those obtained where the electrolyte does contain such ions, especially *ab initio* (i.e. copper sulfate or zinc sulfate).

Suitably, the resist surface does not permit the passage of electrolyte between itself and the surface of the metal in contact therewith, unless removed therefrom. Such resists include the conventional hard and soft grounds. However, where aquatinting of the main metal surface is sought, there may be used a resist surface which permits the random passage of electrolyte between itself and the surface of the metal in contact with the major portion of said resist surface, such as partially fused rosin dust.

The process may be modified and fine tuned in several ways. For example, a stream of air may be passed through the electrolytic cell. Sensing and or adjusting (continuously or intermittently) the pH of the electrolyte may be useful as would be similar actions with respect to temperature. Generally speaking, temperature adjustment is not needed as current flows are usually quite small. However where large plates are used or substantial areas are exposed for long periods of time, the temperature may rise substantially above ambient. Such temperature rises do not substantially affect the process itself (although they do increase the current flow) but should be avoided as they may lead to a softening and eventual separation of the resist from the metal, leading to etching in undesired segments of the work.

Special and unusual surface effects can be achieved by, inter alia, deliberately permitting leakage under portions of the resist or, during the process, arranging that the polarity of the anode and the cathode as originally designated, are reversed at least once during the course of the process.

DETAILED DESCRIPTION OF THE DRAWINGS

Figure 1:
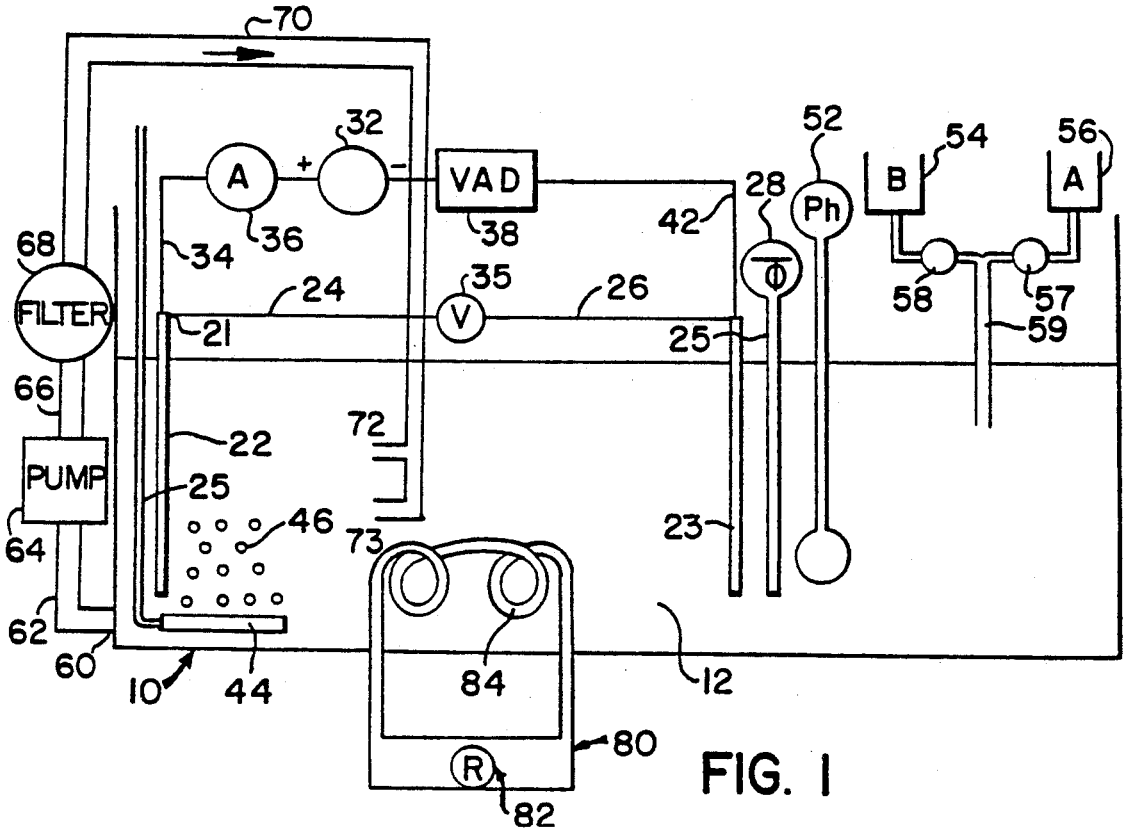
FIG. 1 is a schematic side-elevational representation of an apparatus of the present invention.

FIG. 1 is a schematic side-elevational view of an apparatus of the present invention showing all of the possible monitoring and condition adjustment mechanisms. The mode of connecting the detecting mechanism to the adjusting mechanisms to provide automatic feed-back and adjustment upon change of preset conditions, would be apparent to one skilled in the art.

The apparatus as illustrated comprises an electrolytic bath 10 containing electrolyte 12. Immersed in the bath is the metallic plate 22 to be etched and an electrode 23 which may but, need not be, metallic. It is preferred but not essential, that electrode 23 which will serve as the cathode, be either a metallic plate or metallic mesh of the same metal as metallic plate 22, or else a carbon block, rod, or mesh of woven carbon fiber. A source of direct current 32, has a positive pole, which is connected via line 34 to point 21 on plate 22 and negative pole of source 32 is connected to point 25 of electrode 23 via line 42. The voltage adjustment device 38 is illustrated as being between the negative pole of the power source and electrode 25. It could just as readily be placed between the positive pole and metallic plate 22. A voltage measuring device 25 is shown between cathode 23 and anode 22, being connected thereto by lines 26 and 24 respectively. A current measuring device is shown in line 34. Said current measuring device could also be placed in line 42.

Figure 5:
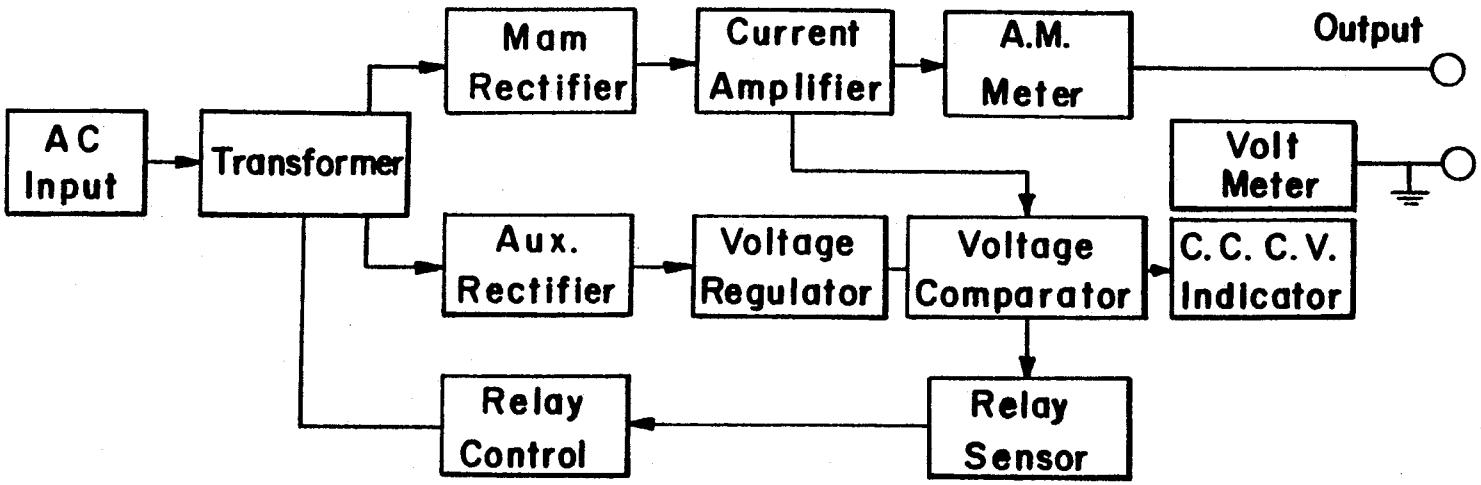
FIG. 5 is a schematic representation of a combined power source voltage adjustment mechanism.
Figure 7:
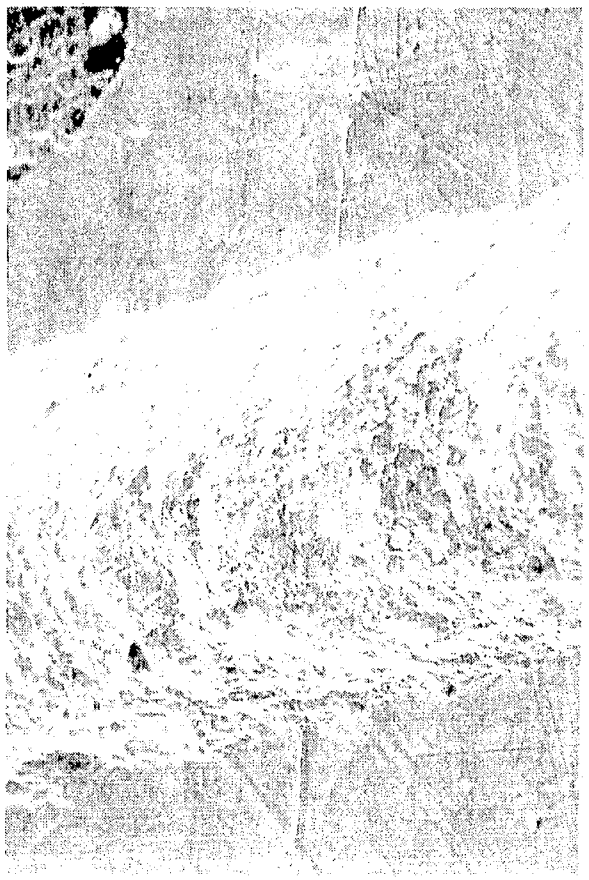
FIG. 7 is a photomicrograph of a line etched into a test plate by the present process showing the differentiated crystalline surface structure.

In the preferred embodiment of the invention, the power source 32 and the voltage adjustment device 38 may be combined in a single unit (Kappa/Viz cc/cv. DC power supply, Model WP 773, manufactured and sold by Vector Viz, Horsham, Pa.). The requisite circuitry for such a device is shown in FIG. 5. This device has an AC input and DC output which can be adjusted to and within the desired range. Since the current and voltage measuring devices, which are integral with this unit are not highly accurate, it is advisable to have the external measuring devices 25 and 36 to ensure that the applied voltage falls within the desired range.

The apparatus may further comprise a sintered disk 44 having attached thereto a compressed air lead 25, through which air can be passed, providing aerating and stirring bubbles 26.

There may further be provided a temperature measuring device 28 and a refrigeration means 80. This refrigeration means 80 may comprise a refrigeration coil 84 attached to a refrigeration source 82. This refrigeration means 80 may be manually controlled when the reading of temperature measuring device 28 exceeds a predetermined level or temperature control device 28 may directly control refrigeration device 80.

There is also provided a pH measuring means 52. There may also be provided a pH adjusting means, which comprises a source of acid 56 or base 54, controlled respectively by valves 57 and 58, entering into conduit 59. When the pH measuring device 52 indicates a pH in the electrolyte outside a predetermined range, valves 57 or 58 as appropriate, can add acid or base to make the desired adjustment. pH measuring device 52 can also be arranged to directly control valves 57 and 58, in manners well known in the art.

Figure 9:
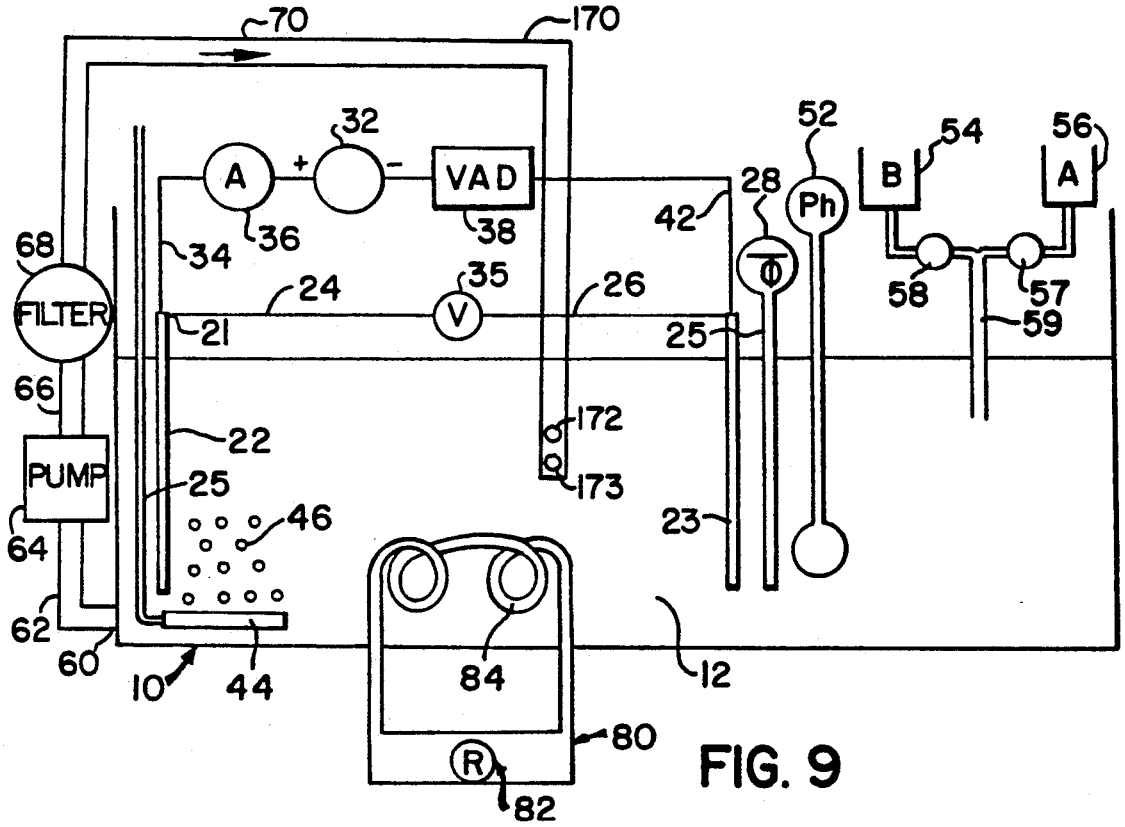
FIG. 9 is a schematic side-elevational representation of an apparatus of FIG. 1 showing an alternate arrangement of the jets.

In a preferred embodiment, the device may comprise a external electrolyte circulation system comprising an output port in the bath, a pump and an input port. In one particularly preferred modification, output port 60 is connected to pump means 64 by conduit 62. Suitably a filter means 68 is connected to pump means 64 by conduit 66 and further to inflow conduit 70 which terminates in an input port such as one having at least one jet 72. However a plurality of jets (i.e. 73, et seq.) may also be employed. Such jet or jets may, as illustrated be oriented to direct the flow substantially perpendicularly against an electrode, such as the metallic object. Alternatively, as illustrated in FIG. 9, inflow conduit 170 may terminate in one or more jets (172, 173 et seq.) which direct the flow in an initial direction substantially parallel to the plates 22 and 23. Due to the turbulence existing in the bath the terms "perpendicular" and "parallel" will be interpreted by those skilled in the art to be approximate and not exact indicators of direction.

Figure 2:
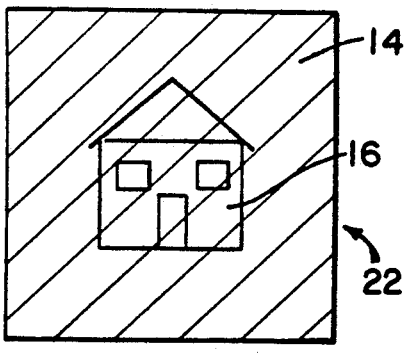
FIG. 2 is a plan view of a metallic plate covered by resist having a potential image drawn in said resist.
Figure 3:
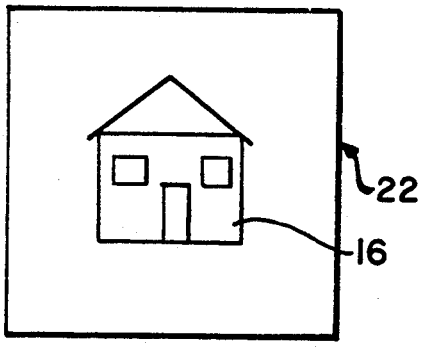
FIG. 3 is a plan view of the plate of FIG. 1 after etching and removal of the resist.

In FIG. 2 which is a plan view of plate 22, the front and back (not shown) of plate 22 are covered with a resist such as a hard ground, suitably LeFranc and Bourgeois #3764 into which the desired image 16 is drawn, suitably with a needle, to provide a small exposure of the surface of the metal 22. After completion of the etching step, the resist is removed, suitably by dissolving it in a suitable solvent such as gasoline or naphtha, to leave the engraved image 16 in the surface of the plate as shown in FIG. 3.

Where items are designated by three digits, items having the same last two digits are substantially similar as are items designated only by those two digits.

Figure 4:
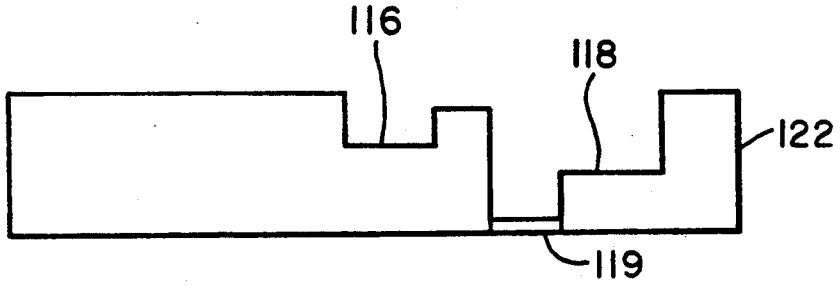
FIG. 4 is a cross-sectional elevational view of a thick metallic plate showing embossment and total removal of the metal.

FIG. 4 illustrates a different mode wherein the process is allowed to continue to provide deep etches or embossments 116 and 118 in plate 122, as well as a complete cut-through 119.

Where it is desired to carry out the anodic etch with the metallic plate in a horizontal orientation or where artistic factors require total immersion of a vertically oriented plate, the connection to the power source has to be under the electrolyte. Special precautions must be taken in order to avoid the occurrence of etching where this is not desired. One embodiment of such a connection is shown in FIG. 6.

Figure 6:
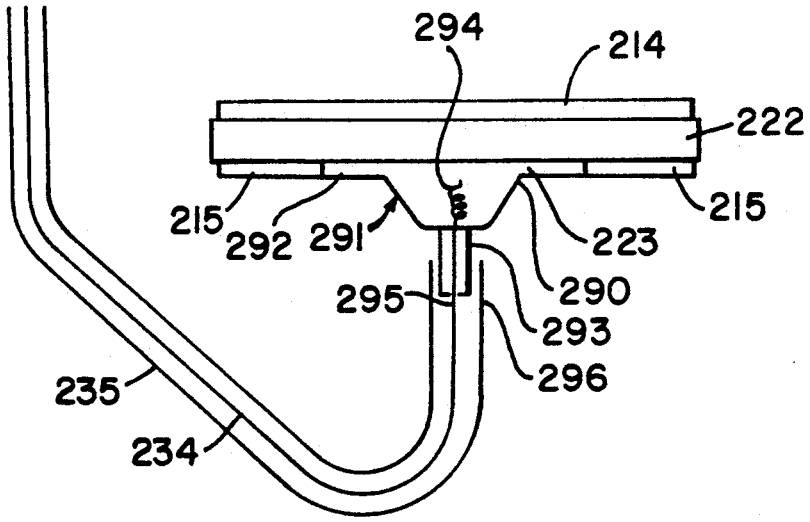
FIG. 6 is a partial cross-sectional elevational view showing connection of the metallic plate to the potential source in the horizontal plating mode.

In FIG. 6, plate 222 is coated on the side to be etched by coating 214, into which the design is drawn in the usual manner. Similarly, the rear or bottom part of the plate 222 is coated with a resist in areas 215, leaving an area 223 uncoated.

There is placed on this area 223 a small plunger device 290, which comprises a substantially conical segment 291 with an annular flange 292 and an axial cylindrical protrusion 293. This plunger is suitably made of rubber or a highly flexible thermoplastic. When this plunger is pressed against surface 223, wherein the interface suitably but not critically has been dampened with water, the air is driven out of the internal portion of the conical section 291 and the plunger adheres to the surface by atmospheric pressure.

The electrical connection is provided by a wire 295, having a spring segment 294. The wire 295 passes through the cylindrical segment with spring segment 294 remaining within the conical segment 291. Thus, when the plunger 290 is pressed against surface 223, spring 294 makes and holds electrical contact with the metal of the plate. The protruding wire 294 is connected to lead 234 within an insulated jacket 235 by means of a conventional water-proof connecting means 296 which seals the opposed ends of insulated jacket 235 and cylindrical member 293 from the water while connecting lead 295 to wire 234. Wire 234 is then connected to the positive pole of the power source in the conventional manner.

In carrying out the process of the present invention, there is utilized an electrolyte which contains electroconductive ions. The concentration of electro-conductive ions can be quite low; a concentration of 0.05–0.2M is entirely adequate. Higher concentrations accelerate the performance of the process. Thus concentrations of the order of 0.75 gm. equivalents/liter have been found to give good results. Concentrations closer to the saturation point of the electrolyte, while operative, are not especially favored. As the anion, there may be utilized any anion, whether of a strong or a weak acid. Chlorides, nitrates, sulfates, acetates, and the like, may be utilized. It is not important whether the anion is organic or inorganic. However, from the point of view of availability and solubility, as well as lack of toxicity, sulfates are generally preferred. Similarly, the cation is preferably a cation which is present in the metallic plate or object which is utilized as the anode. This however, is not essential and the cation may be the ammonium anion or the ion of an alkali metal, this latter mode however is not preferred.

The pH of the electrolyte may be above or below 7. For regular etching processes, it is preferred to utilize pHs below 7, preferably between 3 and 6, suitably between 3 and 5. Lower pHs are not favored because at lower pHs the acids themselves will act as etchants and furthermore, neutralization prior to disposal, is an added expense. Similarly, electrolytes of high pH are generally undesirable because of the neutralization problem. Furthermore, unless special surface effects are desired (which cannot be ruled out for reasons of artistic effect), electrolytes of pH above 7 are generally undesired because of the formation of metallic oxides or hydroxides, which tend to passivate the anode because of the formation of metallic oxides or hydroxides.

The temperature is not critical, provided that it does not interfere with the adhesion of the resist to the metal plate. Thus operative temperatures will range from the freezing point of the electrolyte to about 30° C. However, at this higher temperature some softening of certain resists may begin. Therefore, it is preferable not to exceed 26° C. Where a pumping system is not employed, circulation of the electrolyte can be enhanced by bubbling air through sintered disk 44 via inlet tube 25. Care should be taken however that the flow of air is not so intense as to cause loss of electrolyte by spattering.

The voltage at which the process is operated depends upon a combination of the constituents of the electrolyte, the nature of the metal plate and the nature of the electrode. The voltage should be sufficiently high to enable to metal of the metal plate to be converted into the ions. The voltage relative to a standard hydrogen electrode (O v.) will range from $-1.42$ volts for gold ($Au - 3e = Au^{+++}$), to $+0.76$ volts for zinc ($Zn - 2e = Zn^{++}$). The specific voltages may noted from the known reduction potentials. The upper limit for the cell is the highest voltage at which hydrogen is not generated at the cathode. Generally speaking, this is a function of the relationship between the material of the cathode and the electrolyte. For copper in copper sulphate, for example, this theoretically lies in the region of approximately 1.7 volts. However, there is an additional, incompletely understood, phenomenon, known as over-voltage, which raises the voltage at which hydrogen may be generated by a further amount, usually about 0.5 volts.

The length of time during which the etching is carried out relates directly to the depth of cut desired. Utilizing copper at a voltage of 0.5 volts, an ink-retaining etch is obtained after as little as 5 minutes. After about 90 minutes, the etch becomes deeper and wider than is generally accepted in graphic arts. However, such etched depth is acceptable where special effects are desired. Indeed, longer periods of etching over substantial areas may be employed where it is desired to create an embossment, or even a total cut through the metal plate. Since the present technique may be employed for jewelry, the term "metal plate" is in no way limited to a piece of metal which is flat and even. The process is equally applicable for anodes of varied shapes and thicknesses.

All of the metal which is etched from the anode is deposited upon the cathode. Depending upon the nature of the cathode surface, the metal is either retained thereon or falls to the bottom of the electrolytic bath from which it may be readily removed and recovered by filtration.

In addition to the aforementioned effects of etching a design or embossing or cutting the metal, the techniques of the present invention may be equally well employed for the provision of aquatints, wherein the resist is coated onto the metallic plate in such a way that there is selective adhesion and therefore selective etching, giving rise to the well known rough surface which can be utilized to retain ink in the conventional manner.

EXAMPLES

General Experimental Conditions

The examples set forth below were carried out under certain general conditions. The cathode was a plate of the same metal as that of the anode plate to be etched. The metals used were zinc and copper. The back part of the anode was covered with a resist of transparent adhesive plastic known commercially as "Con-Tact® sheeting" which overlapped the side and bottom edges of the plate by about 0.3". The juncture of the plastic with the front part of the plate was sealed with a thin film polyacrylic solution. The remaining part of the front of the plate was covered with Le Franc and Bourgeois hard ground #3764, on which, when dry the design to be etched was drawn.

The anode and the cathode were placed in a bath of electrolyte, facing each other about 2" apart. The power source was Kappa/Viz cc/cv. DC power supply, Model WP 773, manufactured and sold by Vector Viz. Horsham, Pa. Actual Current flow in milliamps and potential between the plates were measured to 3 significant figures. Temperature was measured by an immersed thermometer and pH with pH paper. Temperature adjustment was with an external ice bath. No pH adjustment was required.

EXAMPLE 1 a) Metal: Copper (18 Gage) Electrolyte: 0.2 M Copper Sulfate. pH 4.0

| Time in min. | voltage | mA | °C. | Comment |
|---|---|---|---|---|
| 0 | 1.00 | 52 | 22 | Full picture exposed |
| 10 | 1.06 | 48 | " | Tower blocked |
| 20 | 1.04 | 15 | " | Tree blocked |
| 30 | 1.03 | 15 | " | Pond + Path blocked |
| 40 | 1.03 | 15 | " | House/Mts Left. |

b) Metal: Zinc (20 Gage) Electrolyte: 0.2 M Zinc Sulfate. pH 4.0

| Time in min. | voltate | mA | °C. | Comment |
|---|---|---|---|---|
| 0 | .503 | 25 | 22 | Full picture exposed |
| 15 | .503 | 25 | " | Tower blocked |
| 35 | .502 | 25 | " | Tree blocked |
| 55 | .503 | 22 | " | Pond + Path blocked |
| 75 | .502 | 18 | " | House/Mts Left. |

The original design included a house with a tower attached with a pond and a tree in front and a range of mountains behind. As shown in the table portions of the design were successively blocked out with hard ground. The resist was dissolved off with gasoline and the plate then printed in the conventional manner by rubbing ink into the etched lines on the plate, cleaning the surface of the plate, laying damp paper over the inked side of the plate and running through a French Tool bed/roller press. All lines were clearly printed. The tower was a little light, and clear differences in intensity could be seen for all time segments.

EXAMPLE 2

The process was carried out in the general manner except that in place of hard ground a second layer of Con-Tact® sheeting was put on the front face. An outline of a head, about 2 mm wide was drawn and the drawn segment cut out with a sharp blade to expose the copper.

Metal: Copper (18 Gage) Electrolyte: 0.2 M Copper Sulfate. pH 3.5

| Time in hrs. | voltage | mA | °C. | Comment |
|---|---|---|---|---|
| 0 | 1.09 | 50 | 22 | Start |
| 17 | 1.04 | 45 | " | Breakthrough noted at sharp angles on figure |
| 28.7 | 1.08 | 30 | " | ca. 10% not cut through |
| 29.7 | 1.05 | 40 | " | complete cut. |

The cut was substantially perpendicular to the front face. At the back of the place a small residue was left on the central, i.e. "cut out" segment. This is in contrast to undercutting observed with deep acid etching. During the process copper dust was noted floating in the vicinity of the anode.

EXAMPLE 3

In place of hard ground, rosin was dusted on the plate and partially melted in the conventional manner to provide an aquatint resist. The anode was about 4" square as was the cathode. At 20 minute intervals segments of the plate were covered with stop out varnish.

Metal: Copper Electrolyte: 0.2 M Cupric Sulfate. pH: 4.0

| Time in min. | voltage | mA | °C. | Comment |
|---|---|---|---|---|
| 0 | 0.80 | 250 | 22 | Start |
| 20 | 0.68 | 250 | " | Voltage reduced to prevent current exceeding 250 mA |
| 40 | 0.68 | 250 | " | |
| 60 | 0.72 | 240 | " | |
| 80 | 0.71 | 160 | " | Stop |

The Con-Tact® backing was stripped off and resist was dissolved off with gasoline and the plate then printed in the conventional manner by rubbing ink into the etched lines on the plate, cleaning the surface of the plate, laying damp paper over the inked side of the plate and running through a French Tool bed/roller press. A clear differentiation of different shades of grey were noted between the segments.

EXAMPLE 4

Figure 8:
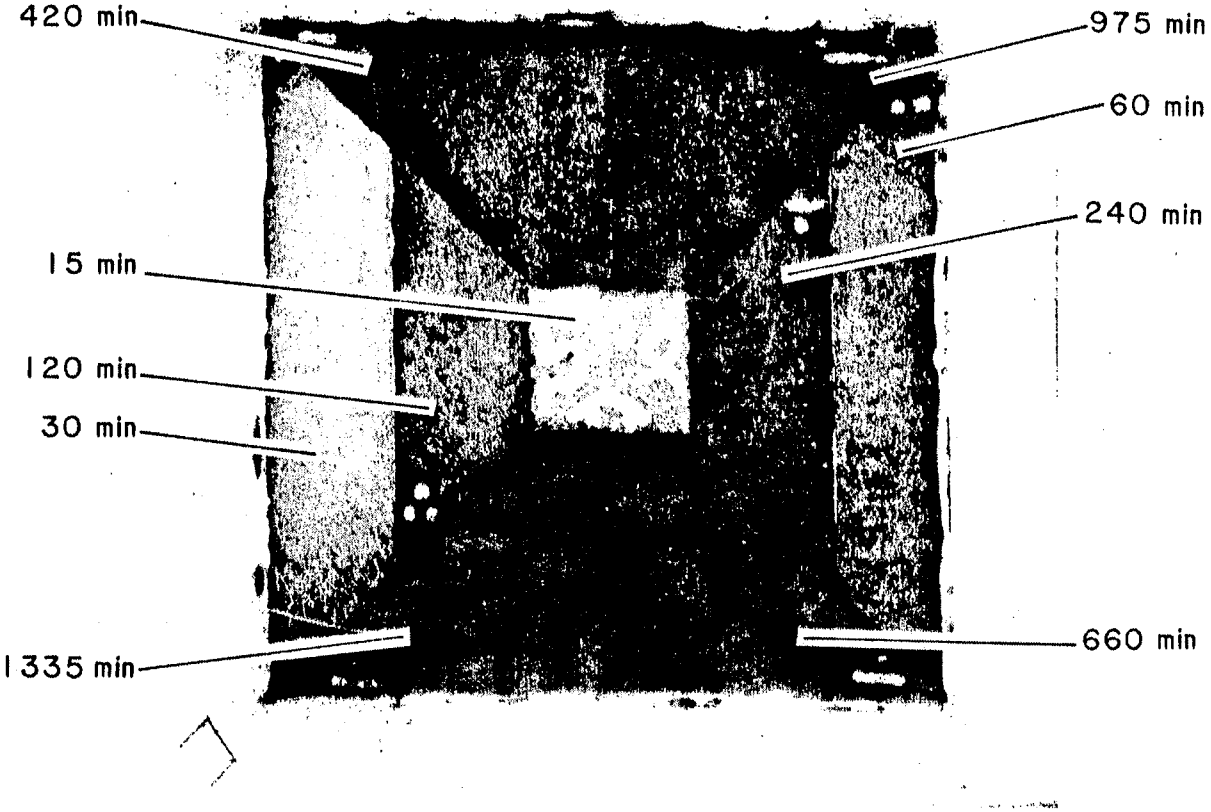
FIG. 8 is a photograph of a test plate showing a series of simulated aquatint segments.

In accordance with the general method, a copper plate was cleaned successively with acetone, isopropyl alcohol, and soap-and-water, to remove all traces of grease, and immersed in the bath with a jet projecting electrolyte "parallel" to and between the anode and the cathode. After each interval, the anode was removed from the bath and brushed with a soft brush under a stream of water to remove the brown/purple residual copper and dried. A segment of the plate was coated with a stop out varnish formulated for electroplating (MICCROSHIELD® manufactured by Miccro Products, Tolber Div., Pyramid Plastics Inc., Hope, Ark., U.S.A.). The resultant plate is illustrated in FIG. 8.

| Metal: Copper | Electrolyte: 0.75 M Cupric Sulfate. pH: 4.0 | | | |
|---|---|---|---|---|
| Time in min. | voltage | mA | °C. | Comment |
| 0 | 0.49 | 730 | 26 | Start |
| 15 | 0.49 | 730 | " | |
| 30 | 0.49 | 620 | " | |
| 60 | 0.49 | 620 | " | |
| 120 | 0.49 | 360 | " | |
| 240 | 0.49 | 450 | " | |
| 420 | 0.49 | 480 | " | |
| 660 | 0.49 | 380 | " | |
| 975 | 0.49 | 310 | " | |
| 1335 | 0.49 | 140 | " | Excess pitting. Stop |

The Con-Tact ® backing was stripped off and resist was dissolved off with (MICCROSTRIP B ® manufactured by Miccro Products, Tolber Div., Pyramid Plastics Inc., Hope, Ark., U.S.A.) and the plate then printed in the conventional manner by rubbing ink into the roughened areas on the plate, cleaning the surface of the plate, laying damp paper over the inked side of the plate and running through a French Tool bed/roller press. A clear differentiation of different shades of grey were noted between the segments.

EXAMPLE 5

The process was carried out in the general manner except that in place of hard ground a layer of soft ground was coated on the plate and a paper heart outline and a pair of small leaves were placed on the soft ground and pressed in with the roller/bed press. The plate was backed with spray enamel and edged with hard ground.

| Metal: Copper (18 gage) | Electrolyte: 0.2 M Cupric Sulfate. pH: 3.5 | | | |
|---|---|---|---|---|
| Time in min. | voltage | mA | °C. | Comment |
| 0 | 1.03 | 80 | 22 | Start |
| 25 | 1.03 | 80 | " | |

The resist was removed by dissolution in gasoline and the plate printed as in the previous example. Shading was noted in the "heart" but not all details were reproduced from the leaves. Etch time may be too long.

EXAMPLE 6

The process was carried out in the general manner except that in place of hard ground a layer of soft ground was coated on the plate an open weave patterned muslin cloth with a paper figure outline placed thereon and pressed in with the roller/bed press. The plate was backed with spray enamel and edged with hard ground.

| Metal: Copper (18 gage) | Electrolyte: 0.2 M Cupric Sulfate. pH: 3.5 | | | |
|---|---|---|---|---|
| Time in min. | voltage | mA | °C. | Comment |
| a) 0 | 1.06 | 120 | 22 | Start |
| 15 | .98 | 160 | " | |
| b) 0 | 1.06 | 150 | 22 | Start |
| 20 | 1.06 | 150 | " | |

The resist was removed by dissolution in gasoline and the plate printed as in the previous example. All details were was noted but in (a) not all details were reproduced strongly thus etch time may be too short. In (b) the reproduction of detail was indistinguishable from results from a similarly prepared acid etched plate.

EXAMPLE 7

In accordance with the general procedure two copper plates were prepared whereon two areas of 4 $cm^2$ on each plate were blocked out under the hard ground resist, the Con-Tact sheeting. (a) One such area was exposed on each plate and the plates were then etched at 0.5 V and ca. 22° C. for 30 minutes in baths of 0.75M Copper sulfate and ammonium sulfate respectively and the amperage tracked. (b) The experiments were repeated in that on the plate to be immersed in ammonium sulfate the second area was exposed and the initial area was blocked with stop out varnish. (c) The experiments were repeated in that on the plate to be immersed in copper sulfate the second such area was also exposed leaving the first open and on the other plate the second area was again exposed (the first still being blocked with stop out varnish.

| Time in min. | mA Cu++ | mA $(NH_4)^-$ | °C. | Comment |
|---|---|---|---|---|
| a) 0 | 120 | 70 | 22 | Start |
| 1 | 100 | 40 | " | |
| 2 | 90 | 40 | " | |
| 15 | 80 | 30 | " | |
| 20 | | 30 | " | |
| 30 | 80 | 30 | 22 | stop |
| b) 0 | | 60 | 22 | Start |
| 1 | | 50 | " | |
| 2 | | 50 | " | |
| 10 | | 50 | " | |
| 20 | | 50 | " | |
| 30 | | 50 | " | Stop |
| c) 0 | 200 | 70 | 22 | Start |
| 1 | 160 | 70 | " | |
| 2 | | 50 | " | |
| 10 | | 40 | " | |
| 15 | 160 | 40 | " | |
| 30 | 160 | 40 | " | Stop |

Optical examination in a 10 power magnifier shows that there was surface erosion to show the micro-crystalline sub-surface structure in all four cases. However with the ammonium sulfate current flow was lower even ab initio, the depth of erosion appeared to be less at 30 minutes and was definitely less after one hour than where copper sulfate was the electrolyte. The resist was dissolved off with kerosene and the plates then printed in the conventional manner by rubbing ink into the eroded areas lines on the plate, cleaning the surface of the plate, laying damp paper over the inked side of the plate and running through a French Tool bed/roller press. All eroded areas printed grey. A clear differentiation of different shades of grey between the segments exposed for one hour in the different electrolytes was noted, the segment from the copper sulfate being markedly darker.

We claim:

1. A process of etching a roughened surface directly onto a metallic object, the original surface whereof is partially covered by a resist surface and causing the thus exposed portions of said metal object to be subjected to the action of an etchant force in an electrolytic bath containing an aqueous electrolyte, an electrode and a source of direct current voltage having a positive pole and a negative pole, comprising the steps of a) immersing said metallic object to be etched in said bath proximate to but spaced from said electrode, b) connecting the negative pole of said direct current voltage source to said electrode and the positive pole to said metal object whereby said electrode becomes the cathode and said metal object becomes the anode and c) applying direct current voltage, wherein the improvement comprises providing the applied voltage so that it shall be at least that of the ionization potential of the metal of the object in the electrolyte chosen and shall not substantially exceed the sum of the decomposition voltage of the aqueous electrolyte and the over-voltage of the cathode selected, whereby hydrogen evolution is avoided and applying said selected voltage until the desired depth of metal has been removed from the exposed portions of the anode and the desired degree of roughness attained thereon.

2. A process of claim 1 wherein said direct current voltage source additionally comprises a means for adjusting the voltage.

3. A process of claim 1 wherein the metal object is a plate.

4. The process of claim 1 wherein the metal of the metal plate is zinc, copper, brass, bronze, iron or steel or a noble metal.

5. The process of claim 4 wherein the process is carried out at a pH of less than 7.

6. The process of claim 4 wherein the process is carried out at a pH of more than 7.

7. The process of claim 4 wherein the proces is carried out utilizing an electrolyte containing cations of none of the metals constituting the anode.

8. The process of claim 1 wherein the passage of electrolyte between the resist surface and the surface of the metal in contact therewith is prevented.

9. The process of claim 8 wherein predetermined segments of the metal are exposed by removal of the resist surface prior to the application of voltage.

10. The process of claim 9 wherein said segments are substantially linear segments.

11. The process of claim 1 wherein the random passage of electrolyte between the resist surface and the surface of the metal in contact with the major portion of said resist surface is permitted.

12. The process of claim 11 wherein predetermined segments of the metal are exposed by removal of the resist surface prior to the application of voltage.

13. The process of claim 1 wherein the applied voltage is between 0.4 and 1 volt.

14. The process of claim 1 additionally comprising the step of sensing the pH of the electrolyte.

15. The process of claim 14 additionally comprising the step of adjusting the pH of the electrolyte.

16. The process of claim 1 additionally comprising the step of sensing the temperature of the electrolyte.

17. The process of claim 16 additionally comprising the step of adjusting the temperature of the electrolyte.

18. The process of claim 1 wherein the polarity of the anode and the cathode as originally designated are reversed at least once during the course of the process.

19. The process of claim 1 wherein a stream of electrolyte is directed initially substantially perpendicularly against the surface of the metal object facing the cathode.

20. The process of claim 1 wherein a stream of electrolyte is directed initially substantially parallely between the surface of the metal object facing the cathode and the cathode.

21. An apparatus for etching a roughened surface onto a metallic object the original surface whereof is partially covered with a resist surface by causing the thus exposed portions of said metal object to be subjected to the action of an electrolytic etchant force, comprising a) a bath for containing an aqueous electrolyte, b) an electrode located in said bath and immersible in said electrolyte to form a cathode, c) a source of direct current voltage whose positive pole is adapted for connection to said object when immersed in said electrolyte proximate to but spaced from said electrode the negative pole of said source being adapted for connection to said electrode when immersed in said electrolyte, wherein the improvement comprises means for controlling voltage so that the magnitude of voltage from said source is at least that of the ionization potential of the metal of the object in the electrolyte chosen and not substantially greater than the sum of the decomposition voltage of the aqueous electrolyte plus the over-voltage of the cathode selected whereby hydrogen evolution is avoided.

22. The apparatus of claim 21 additionally comprising means for passing a stream of air through said electrolytic cell.

23. The apparatus of claim 21 additionally comprising means for sensing the pH of the electrolyte.

24. The apparatus of claim 23 additionally comprising means for adjusting the pH of the electrolyte.

25. The apparatus of claim 21 additionally comprising means for sensing the temperature of the electrolyte.

26. The apparatus of claim 25 additionally comprising means for adjusting the temperature of the electrolyte.

27. The apparatus of claim 21 additionally comprising means for reversing the polarity of the anode and the cathode.

28. The apparatus of claim 21 additionally comprising means outside said bath for circulating said electrolyte and jet means for projecting said electrolyte into said bath.

29. The apparatus of claim 28 wherein said jet means is oriented to project said electrolyte against the surface of said metal object facing said cathode.

30. The apparatus of claim 28 wherein said jet means is oriented to project said electrolyte between the surface of said metal object facing said cathode and said cathode and initially substantially parallel to both.

* * * * *